US012352057B2

(12) United States Patent
Wang et al.

(10) Patent No.: US 12,352,057 B2
(45) Date of Patent: Jul. 8, 2025

(54) CYLINDRICAL STRUCTURE CONSTRUCTION PLATFORM

(71) Applicant: HAINAN UNIVERSITY, Hainan (CN)

(72) Inventors: Yongwei Wang, Hainan (CN); Qinxi Dong, Hainan (CN); Qunwei Wang, Hainan (CN)

(73) Assignee: HAINAN UNIVERSITY, Haikou (CN)

( * ) Notice: Subject to any disclaimer, the term of this patent is extended or adjusted under 35 U.S.C. 154(b) by 0 days.

(21) Appl. No.: 18/928,382

(22) Filed: Oct. 28, 2024

(65) Prior Publication Data

US 2025/0172005 A1 May 29, 2025

(30) Foreign Application Priority Data

Nov. 27, 2023 (CN) ..... 202311595733.X

(51) Int. Cl.
*E04G 11/20* (2006.01)

(52) U.S. Cl.
CPC ..... *E04G 11/20* (2013.01)

(58) Field of Classification Search
CPC ..... E04G 11/20; E04G 11/22; E04G 11/24; E04G 11/26; E04G 11/28; E04G 11/30; E04G 3/00; E04G 3/24; E04G 3/28; E04G 3/243; E04H 12/00; E04H 12/12; E04H 12/34; E04H 12/341; B66F 2700/00; B66F 2700/02; B66F 2700/025; B28B 1/001; B28B 1/02; B28B 1/14; B28B 1/20;

(Continued)

(56) References Cited

U.S. PATENT DOCUMENTS 6,311,800 B1 * 11/2001 St-Germain ..... E04G 1/20 182/141
7,281,607 B1 * 10/2007 Kiraly ..... E06C 7/12 182/102

(Continued)

FOREIGN PATENT DOCUMENTS

CN 107435438 A 12/2017
CN 108999410 A 12/2018

(Continued)

OTHER PUBLICATIONS

Notification to Grant Patent Right for Invention, Chinese Application No. 202311595733.X, mailed May 22, 2024 (3 pages).

*Primary Examiner* — Timothy Kennedy
*Assistant Examiner* — Baileigh Kate Darnell
(74) *Attorney, Agent, or Firm* — Daniel M. Cohn

(57) ABSTRACT

The present disclosure provides a cylindrical structure construction platform that both a first telescopic portion and an elastic member drive a guiding wheel to tightly abut against an outer template, adjusting radial positions of a pouring pipe and a tamping device according to an outline of the outer template by a second telescopic portion to reduce construction errors, adjusting an inclination angle of the guiding wheel by an adjusting mechanism, a slewing mechanism driving a rotary table to drive the guiding wheel to climb along a surface of the outer template, the pouring pipe is poured layer by layer from the bottom to the top of a pouring cavity to reduce a height difference during pouring for further reducing generation of air holes, the tamping device vibrates layer by layer from the bottom to the top of the pouring cavity to further eliminate the air holes.

6 Claims, 5 Drawing Sheets

(58) Field of Classification Search
CPC ..... B28B 1/26; B28B 1/261; B28B 1/265; B28B 1/266; B33Y 30/00; B33Y 40/00; B33Y 80/00
See application file for complete search history.

(56) References Cited

U.S. PATENT DOCUMENTS

| | | | | |
|---|---|---|---|---|
| 8,757,593 | B2 * | 6/2014 | Killion | E04G 11/24 254/108 |
| 11,021,887 | B2 * | 6/2021 | Keller | E04H 12/341 |
| 2014/0348662 | A1 * | 11/2014 | Schibsbye | E04H 12/12 264/308 |
| 2022/0412107 | A1 * | 12/2022 | Turnquist | E04G 21/0463 |
| 2023/0407665 | A1 * | 12/2023 | Sheinman | B33Y 80/00 |

FOREIGN PATENT DOCUMENTS

| | | | |
|---|---|---|---|
| JP | H06146578 | A | 5/1994 |
| JP | 2018178622 | A | 11/2018 |
| TW | 201510324 | A | 3/2015 |

* cited by examiner

CYLINDRICAL STRUCTURE CONSTRUCTION PLATFORM

BACKGROUND

1. Technical Field

The present disclosure generally relates to the field of building construction technologies, and especially relates to a cylindrical structure construction platform.

2. Description of Related Art

A cylindrical building is a towering structure that discharges smoke into the sky, which is mainly plays a role of performing air flow to assist combustion, discharging smoke and improving combustion conditions thereof. Generally, there are three types of cylindrical buildings: brick cylindrical buildings, reinforced concrete cylindrical buildings and steel cylindrical buildings. In the steel industry, in order to dilute an emission concentration of atmospheric pollutants as much as possible within an acceptable range for persons, it is usually necessary to design a reinforced concrete cylindrical building to a height of tens or even hundreds of meters. A conventional cylindrical building usually built by combining templates with concrete pouring, and templates are installed after steel bars and brackets are tied. The template is formed by splicing inner and outer layers to form a circular ring thereof, and concrete is poured from the top of the circular ring to the interior of the circular ring. The concrete cylindrical building usually has a tall structure with a thin top and a thick bottom thereof. During the concrete pouring process, air holes easily generate due to a fact that a large height difference exists from a top of the template to a bottom of the template so that the concrete easily shakes, which affects a construction quality thereof. It usually needs to perform a plurality of vibrations in a later stage. In order to timely vibrate the concrete, it usually needs a plurality of workers to perform vibration work on a plurality of places by using vibration devices, which is time-consuming and labor-intensive, and low construction efficiency.

SUMMARY

The technical problems to be solved: in view of the shortcomings of the related art, the present disclosure provides a cylindrical structure construction platform which can solve the above problems in the related art.

a cylindrical structure construction platform according to an embodiment of the present disclosure includes:

a plurality of guiding rail frames arranged on the periphery of a cylindrical building in a circumferential array, an inner template and an outer template respectively installed on the cylindrical building, both the inner template and the outer template joined together to form an annular pouring cavity therebetween, a lifting platform movably installed on the plurality of guiding rail frames, a rotary table rotatably arranged on the lifting platform, and a plurality of adjusting members that is capable of radially moving along the rotary table arranged on the rotary table;

a roller member rotatably installed on the adjusting member, and a guiding wheel rotatably arranged on the roller member;

a telescopic member movably installed on the adjusting member, a mounting rack that is capable of vertically moving relative to the telescopic member arranged on the telescopic member, and a pouring pipe and a tamping device arranged on the mounting rack;

a slewing mechanism connected to the rotary table in a transmission connection way and driving the rotary table to rotate relative to the lifting platform;

an elastic member arranged on the adjusting member and pushing the adjusting member to drive the guiding wheel to be tightly abutted against the outer template;

a first telescopic portion connected to the elastic member in a transmission connection way and pushing the adjusting member to move relative to the rotary table through the elastic member;

a second telescopic portion connected to the telescopic member in a transmission connection way and driving the telescopic member to move relative to the adjusting member;

a lifting member arranged on the adjusting member and connected to the mounting rack in a transmission connection way, and configured to adjust a height position of the mounting rack;

an adjusting mechanism arranged on the adjusting member and connected to the roller member in a transmission connection way, and configured to adjust an angle position of the roller member; and an anti-slip mechanism that is capable of tightly clasping the guiding rail frame arranged on the lifting platform.

Wherein the elastic member includes a sliding base, a spring and a limiting rod arranged on the adjusting member, the sliding base movably installed on the limiting rod; the limiting rod including a limiting portion abutting against the sliding base, the spring installed on the limiting rod and pushing the sliding base to drive the sliding base to abut against the limiting portion, the first telescopic portion connected to the sliding base in a transmission connection way and pushing the sliding base to drive the adjusting member to move.

Wherein the slewing mechanism includes a servo motor arranged on the rotary table, a driving gear, and a ring gear arranged on the lifting platform, wherein the servo motor is connected to the driving gear in a transmission connection way and configured to drive the driving gear to rotate, and the driving gear is meshed with the ring gear.

Wherein the lifting member includes a rack, a lifting gear and a driving member, wherein the rack is arranged on the mounting rack, the lifting gear rotatably installed on the telescopic member and meshed with the rack, and the driving member is connected to the lifting gear in a transmission connection way and drives the lifting gear to rotate.

Wherein the driving member includes a driving motor, a first worm and a first worm wheel, wherein the first worm wheel is coaxially arranged with the lifting gear and drives the lifting gear to rotate, the first worm meshed with the first worm wheel, and the driving motor connected to the first worm in a transmission connection way and driving the first worm to rotate.

Wherein the adjusting mechanism includes a motor, a second worm and a second worm wheel, the second worm wheel connected with the roller member and driving the roller member to rotate, the second worm meshed with the second worm wheel, and the motor connected to the second worm in a transmission connection way and configured to drive the second worm to rotate.

Wherein the anti-slip mechanism includes a hydraulic cylinder, a connecting member, a plurality of swinging rods and a pawl, wherein the plurality of swinging rods is rotatably installed on the connecting member and rotatably arranged on the lifting platform, a sliding bar arranged on the connecting member, sliding grooves arranged on the plurality of swinging rods so that the sliding bar is movably installed on the plurality of swinging rods, the hydraulic cylinder arranged on the lifting platform, a piston rod of the hydraulic cylinder connected with the connecting member and pushing the connecting member to move so as to drive the plurality of swinging rods to swing, the pawl rotatably arranged on the plurality of swinging rods, a torsion spring arranged at a joint that the plurality of swinging rods is connected with the pawl, the guiding rail frame including a sawtooth portion abutting against the pawl, the torsion spring acting on the pawl to drive the pawl to be abutted against on the sawtooth portion, the plurality of swinging rods driving the pawl to be close to or far away from the sawtooth portion, and an abutting portion arranged on the plurality of swinging rods and configured to abut against the pawl to prevent the pawl from excessively flipping upwards.

Wherein the lifting platform includes an annular barrel communicated with a pump truck that is positioned on the ground, a mounting ring rotatably arranged on the annular barrel and connected with the rotary table, and the pouring pipe communicated with the annular barrel through the mounting ring.

Wherein both the first telescopic portion and the second telescopic portion are electric telescopic rods.

The present disclosure provides the advantages as below.

The present disclosure provides that both the first telescopic portion and the elastic member drive the guiding wheel to tightly abut against the outer template, adjusting radial positions of the pouring pipe and the tamping device according to an outline of the outer template by the second telescopic portion to reduce construction errors, adjusting an inclination angle of the guiding wheel by the adjusting mechanism, the slewing mechanism driving the rotary table to drive the guiding wheel to climb along a surface of the outer template, the pouring pipe is poured layer by layer from the bottom to the top of a pouring cavity to reduce a height difference during pouring for further reducing generation of air holes, the tamping device vibrates layer by layer from the bottom to the top of the pouring cavity to further eliminate the air holes, after a current pouring cavity is finished and solidified, the inner and outer templates are disassembled again by a cooperation of the lifting member, the first telescopic portion and the anti-slip mechanism, pouring steps are continuously repeated to obtain the layer by layer pouring work, so that manual vibrating costs in a later stage is reduced and a whole pouring efficiency is improved.

BRIEF DESCRIPTION OF THE DRAWINGS

In order to more clearly understand the technical solution hereinafter in embodiments of the present disclosure, a brief description to the drawings used in detailed description of embodiments hereinafter is provided thereof. Obviously, the drawings described below are some embodiments of the present disclosure, for one of ordinary skill in the related art, other drawings can be obtained according to the drawings below on the premise of no creative work.

The element labels according to the embodiment of the present disclosure shown as below:

1 guiding rail frame, 11 sawtooth portion, 2 lifting platform, 21 annular barrel, 22 mounting ring, 3 rotary table, 31 adjusting member, 311 roller member, 312 guiding wheel, 32 telescopic member, 33 mounting rack, 331 pouring pipe, 332 tamping device, 34 first telescopic portion, 35 second telescopic portion, 4 slewing mechanism, 41 servo motor, 42 drive gear, 43 ring gear, 5 elastic member, 51 sliding base, 52 spring, 53 limiting rod, 531 limiting portion, 6 lifting member, 61 rack, 62 lifting gear, 63 driving member, 631 driving motor, 632 first worm, 633 first worm gear, 7 adjusting mechanism, 71 motor, 72 second worm, 73 second worm gear, 8 anti-slip mechanism, 81 hydraulic cylinder, 82 connecting member, 821 sliding bar, 83 winging rod, 831 sliding groove, 84 pawl, 9 torsion spring.

DETAILED DESCRIPTION

Reference will now be made in detail to embodiments, examples of which are illustrated in the accompanying drawings. The accompanying drawings are used to supplementally describe the description in order to provide a thorough understanding of the subject matter presented herein for one of ordinary skill in the related art. According to the described embodiment of the present disclosure, all other embodiments obtained by one of ordinary skill in the related art on the premise of no creative work are within the protection scope of the present disclosure.

A First Embodiment

Figure 1:
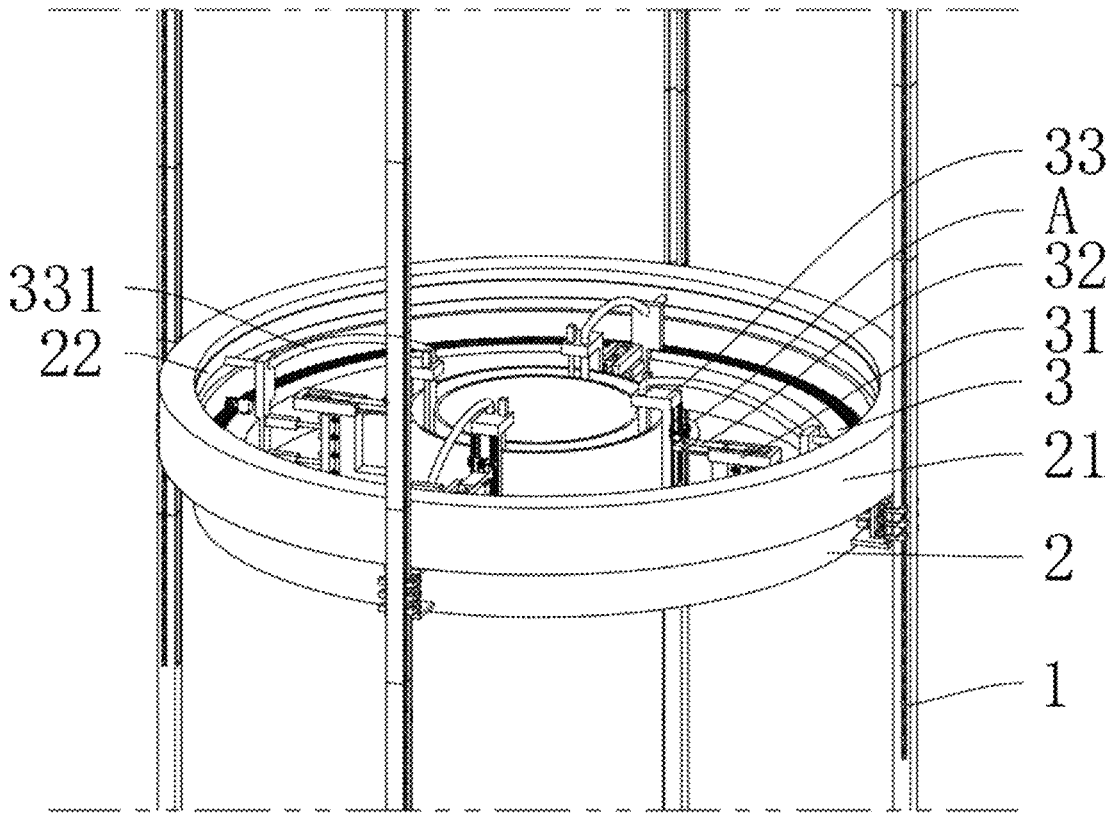
FIG. 1 is a schematic view of a cylindrical structure construction platform in accordance with an embodiment of the present disclosure.
Figure 2:
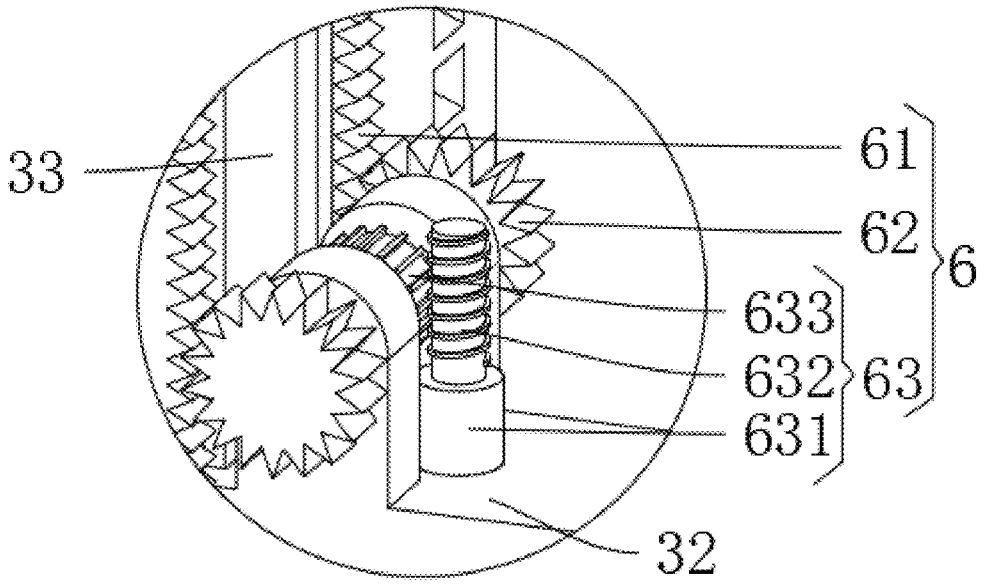
FIG. 2 is an enlarged view of a circle A of FIG. 1.
Figure 3:
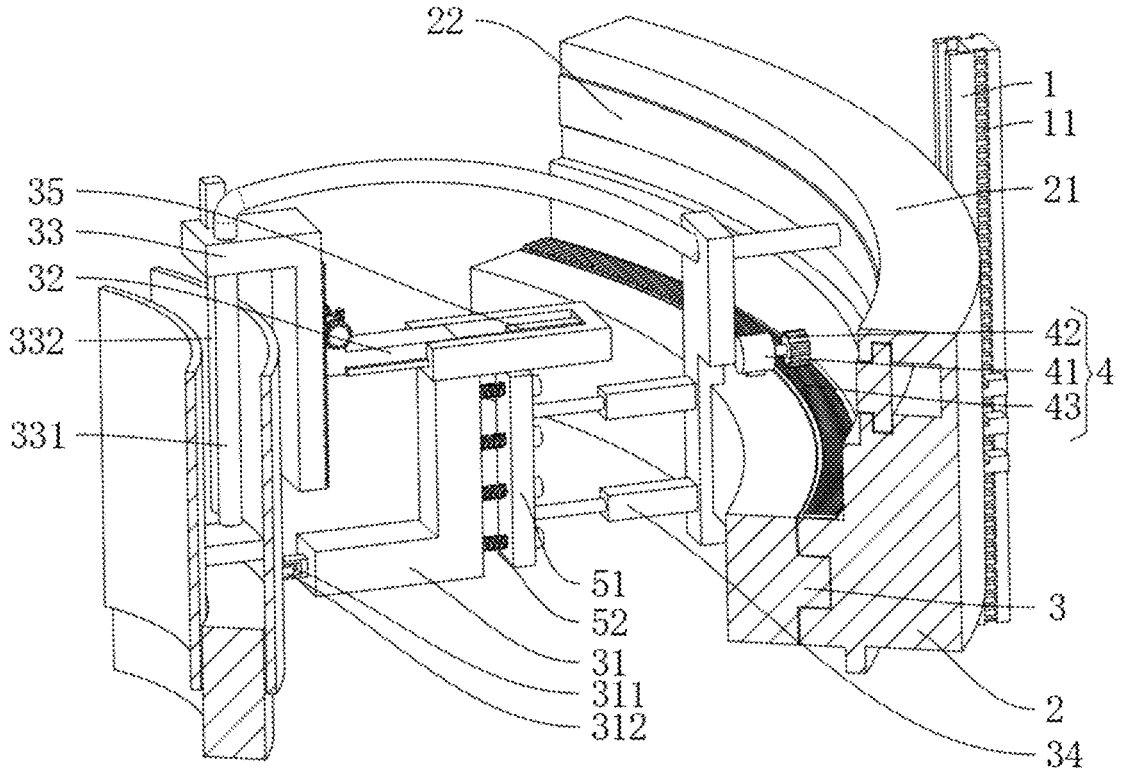
FIG. 3 is a schematic view of a lifting platform and a rotary table of the cylindrical structure construction platform of FIG. 1.
Figure 4:
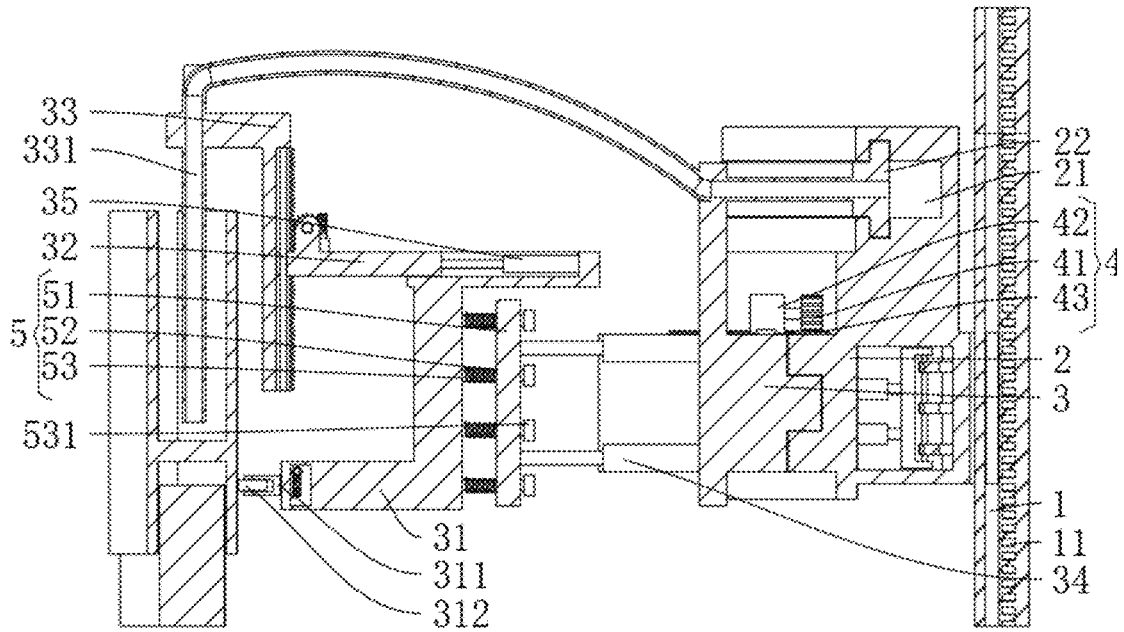
FIG. 4 is a schematic view of a slewing mechanism and an elastic member of the cylindrical structure construction platform of FIG. 1.
Figure 5:
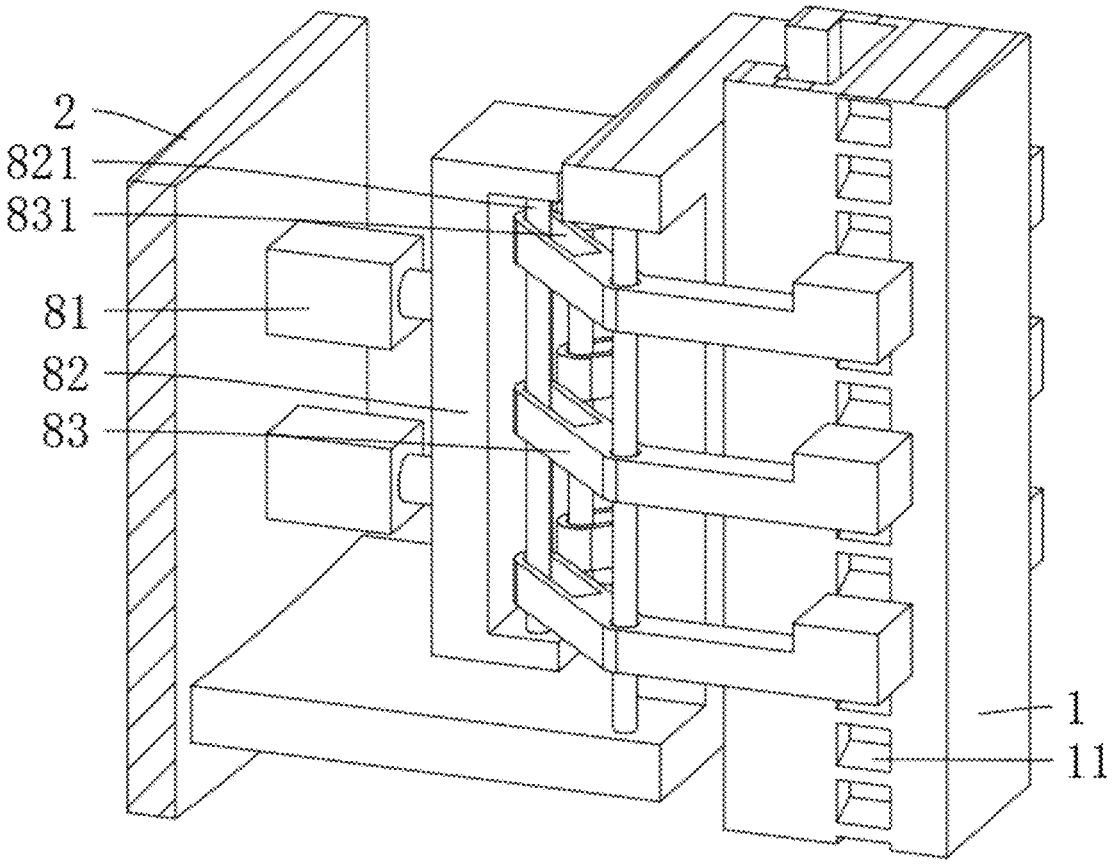
FIG. 5 is a schematic view of a swinging rod and a guiding rail frame of the cylindrical structure construction platform of FIG. 1.
Figure 6:
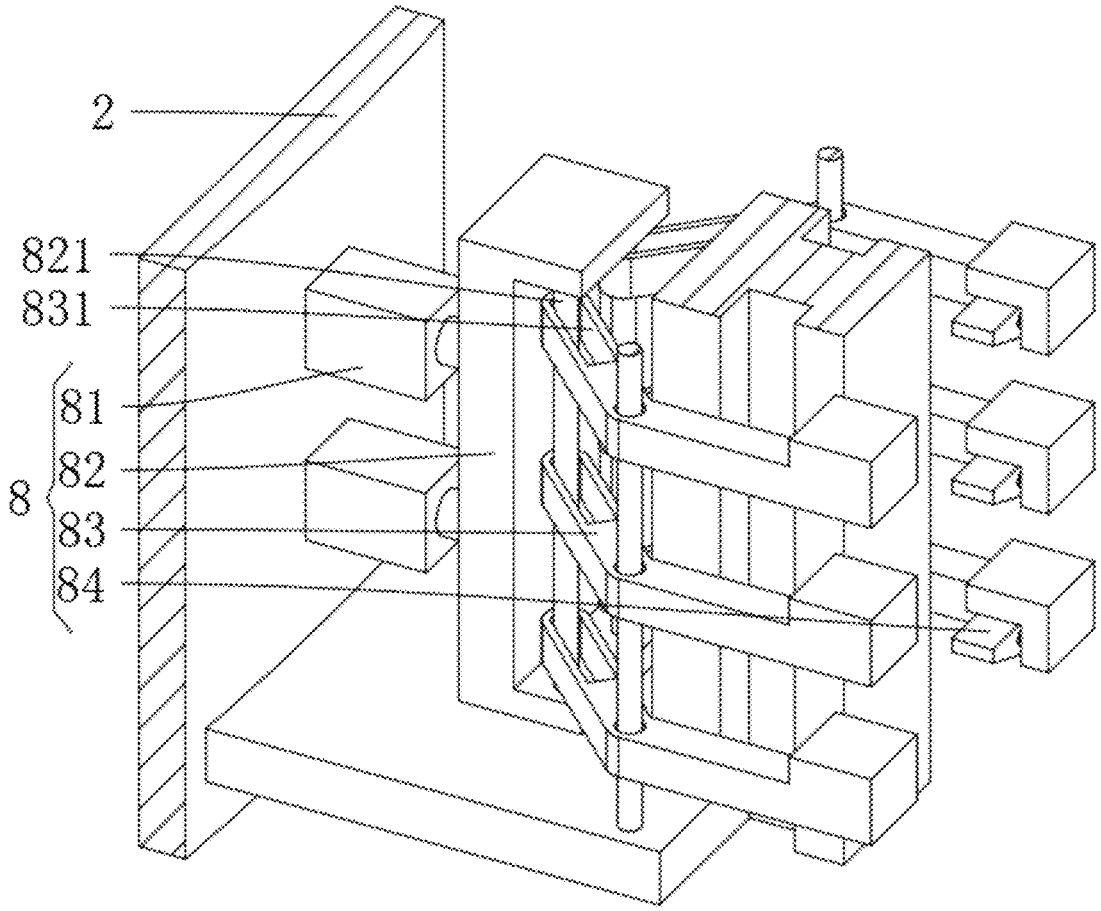
FIG. 6 is a schematic view of an anti-slip mechanism of the cylindrical structure construction platform of FIG. 1.
Figure 7:
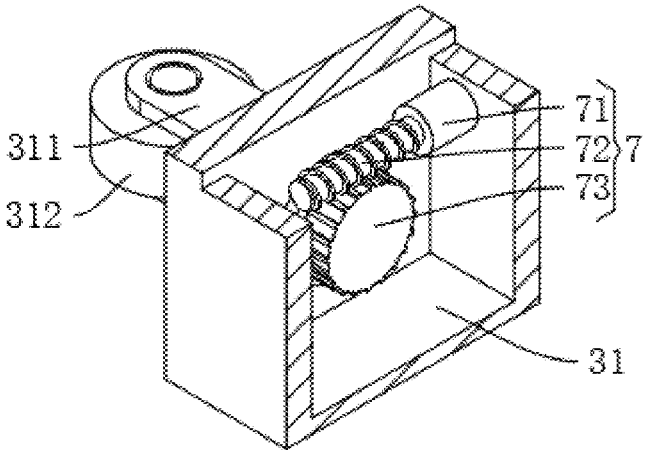
FIG. 7 is a schematic view of an adjusting mechanism of the cylindrical structure construction platform of FIG. 1.
Figure 8:
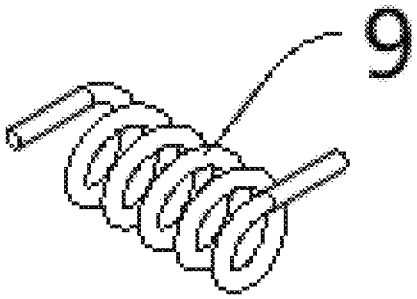
FIG. 8 is a schematic view of a torsion spring of the cylindrical structure construction platform of FIG. 1.

Referring to FIG. 1 to FIG. 8, a cylindrical structure construction platform in accordance with an embodiment of the present disclosure includes:

- a plurality of guiding rail frames 1 arranged on the periphery of a cylindrical building in a circumferential array, an inner template and an outer template installed on the cylindrical building, both the inner template and the outer template joined together to form an annular pouring cavity, a lifting platform 2 movably installed on the plurality of guiding rail frames 1, a rotary table 3 rotatably arranged on the lifting platform 2, and a plurality of adjusting members 31 that is capable of radially moving along the rotary table 3 arranged on the rotary table 3;
- a roller member 311 rotatably installed on the adjusting member 31, and a guiding wheel 312 rotatably arranged on the roller member 311;
- a telescopic member 32 movably installed on the adjusting member 31, a mounting rack 33 that is capable of vertically moving relative to the telescopic member 32 arranged on the telescopic member 32, and a pouring pipe 331 and a tamping device 332 arranged on the mounting rack 33;

a slewing mechanism 4 connected to the rotary table 3 in a transmission connection way and driving the rotary table 3 to rotate relative to the lifting platform 2;

an elastic member 5 arranged on the adjusting member 31 and pushing the adjusting member 31 to drive the guiding wheel 312 to be tightly abutted against the outer template;

a first telescopic portion 34 connected to the elastic member 5 in a transmission connection way and pushing the adjusting member 31 to move relative to the rotary table 3 through the elastic member 5;

a second telescopic portion 35 connected to the telescopic member 32 in a transmission connection way and driving the telescopic member 32 to move relative to the adjusting member 31;

a lifting member 6 arranged on the adjusting member 31 and connected to the mounting rack 33 in a transmission connection way, and configured to adjust a height position of the mounting rack 33;

an adjusting mechanism 7 arranged on the adjusting member 31 and connected to the roller member 311 in a transmission connection way, and configured to adjust an angle position of the roller member 311; and an anti-slip mechanism 8 that is capable of tightly clasping the guiding rail frame 1 arranged on the lifting platform 2.

The first telescopic portion 34 pushes the adjusting member 31 to move through the elastic member 5, and the guiding wheels 312 at positions of the adjusting frame 31 abut against the outer template under an action of the elastic member 5. Combined with the second telescopic portion 35, under a limiting action of the guiding wheels 312, the pouring pipe 331 and the tamping device 332 of the mounting rack 33 can maintain a radial distance from the outer template according to an outer contour of the outer template, that is, positions of the pouring pipe 331 and the tamping device 332 can be adjusted according to an actual contour of the outer template, so that construction errors caused by deviations of the pouring pipe 331 from a preset pouring position can be prevented. an inclination angle of the guiding wheels 312 is adjusted through the adjusting mechanism 7, and the slewing mechanism 4 drives the rotary table 3 to drive the guiding wheels 312 to climb along a surface of the outer template, while driving the lifting platform 2 to climb along the guiding rail frame 1, so that a rotation and a climbing work of the rotary table 3 can be obtained. The rotary table 3 drives the pouring pipe 331 and the tamping device 332 to rotate and climb through the adjusting member 31, the pouring pipe 331 is poured layer by layer from the bottom of the pouring cavity to the top of the pouring cavity, to reduce the height difference during the pouring process, thereby reducing air holes are generated. The tamping device 332 also vibrates layer by layer from the bottom of the pouring cavity to the top of the pouring cavity, which has a good vibration effect and further eliminates the air holes. After the pouring process of a current template is completed and solidified, the mounting rack 33 is driven by all of the lifting member 6, the first telescopic portion 34 and the second telescopic portion 35 to drive the pouring pipe 331 and the tamping device 332 away from a current pouring cavity. The lifting platform 2 is fixed by the anti-slip mechanism 8. The staff removes the inner and outer templates and reinstalls the inner template and the outer template on a basis of a current height, and the above steps are repeated to perform the pouring process layer by layer, which can reduce the air holes caused by vibrations of pouring height differences, and can timely vibrate layer by layer from the bottom of the pouring cavity to the top of the pouring cavity, so as to further eliminate the air holes, and reduce manual vibration costs in the later stage, and improve an overall pouring efficiency thereof.

Specially, the elastic member 5 includes a sliding base 51, a spring 52 and a limiting rod 53 arranged on the adjusting member 31, the sliding base 51 movably installed on the limiting rod 53; the limiting rod 53 including a limiting portion 531 abutting against the sliding base 51, the spring 52 installed on the limiting rod 53 and pushing the sliding base 51 to drive the sliding base 51 to abut against the limiting portion 531, the first telescopic portion 34 connected to the sliding base 51 in a transmission connection way and pushing the sliding base 51 to drive the adjusting member 31 to move.

Specially, the slewing mechanism 4 includes a servo motor 41 arranged on the rotary table 3, a driving gear 42, and a ring gear 43 arranged on the lifting platform 2, wherein the servo motor 41 is connected to the driving gear 42 in a transmission connection way and configured to drive the driving gear 42 to rotate, and the driving gear 42 is meshed with the ring gear 43.

A Second Embodiment

Referring to FIG. 1 to FIG. 8, in combination with the technical solution of the first embodiment, in the second embodiment, the lifting member 6 includes a rack 61, a lifting gear 62 and a driving member 63, wherein the rack 61 is arranged on the mounting rack 33, the lifting gear 62 rotatably installed on the telescopic member 32 and meshed with the rack 61, and the driving member 63 is connected to the lifting gear 62 in a transmission connection way and drives the lifting gear 62 to rotate.

Specially, the driving member 63 includes a driving motor 631, a first worm 632 and a first worm wheel 633, wherein the first worm wheel 633 is coaxially arranged with the lifting gear 62 and drives the lifting gear 62 to rotate, the first worm 632 meshed with the first worm wheel 633, and the driving motor 631 connected to the first worm 632 in a transmission connection way and driving the first worm 632 to rotate.

The driving motor 631 drives the lifting gear 62 to rotate through the first worm 632 and the first worm wheel 633. During a rotation of the lifting gear 62, a height position of the mounting rack 33 can be adjusted through the rack 61 so that a height of the pouring pipe 331 and the tamping device 332 can be adjusted, which is conducive to disassembly and assembly of the inner and outer templates and a normal progress of the pouring work.

Specially, the adjusting mechanism 7 includes a motor 71, a second worm 72 and a second worm wheel 73, the second worm wheel 73 connected with the roller member 311 and driving the roller member 311 to rotate, the second worm 72 meshed with the second worm wheel 73, and the motor 71 connected to the second worm 72 in a transmission connection way and configured to drive the second worm 72 to rotate.

The motor 71 that is cooperated with the second worm 72 and the second worm gear 73 is configured to adjust the angle of the guiding wheel 312. Constructors can adjust the inclination angle of the guiding wheel 312 according to a current pouring volume of the pouring pipe 331, and cooperate the rotation process that the slewing mechanism 4 drives the rotary table 3 to drive the guiding wheel 312 to spirally climb along the outer surface of the outer template, which can reduce the air holes caused by the vibration of the pouring height difference. It can also timely vibrate layer by layer from the bottom of the pouring cavity to the top of the pouring cavity, so as to further eliminate the air holes.

A Third Embodiment

Referring to FIG. 1 to FIG. 8, in combination with the technical solutions of both the first embodiment and the second embodiment, in the third embodiment, the anti-slip mechanism 8 includes a hydraulic cylinder 81, a connecting member 82, a plurality of swinging rods 83 and a pawl 84, wherein the plurality of swinging rods 83 is rotatably installed on the connecting member 82 and rotatably arranged on the lifting platform 2, a sliding bar 821 arranged on the connecting member 82, sliding grooves 831 arranged on the plurality of swinging rods 83 so that the sliding bar 821 is movably installed on the plurality of swinging rods 83, the hydraulic cylinder 81 arranged on the lifting platform 2, a piston rod of the hydraulic cylinder 81 connected with the connecting member 82 and pushing the connecting member 82 to move so as to drive the plurality of swinging rods 83 to swing, the pawl 84 rotatably arranged on the plurality of swinging rods 83, a torsion spring 9 arranged at a joint that the plurality of swinging rods 83 is connected with the pawl 84, the guiding rail frame 1 including a sawtooth portion 11 abutting against the pawl 84, the torsion spring 9 acting on the pawl 84 to drive the pawl 84 to be abutted against on the sawtooth portion 11, the plurality of swinging rods 83 driving the pawl 84 to be close to or far away from the sawtooth portion 11, and an abutting portion arranged on the plurality of swinging rods 83 and configured to abut against the pawl 84 to prevent the pawl 84 from excessively flipping upwards.

In the process that the slewing mechanism 4 is cooperated with the first telescopic portion 34 to drive the guiding wheel 312 to climb along the outer template, the hydraulic cylinder 81 keeps in a contracted state. The pawl 84 of the swinging rod 83 is elastically abutted against the sawtooth portion 11 of the guiding rail frame 1 under the action of the torsion spring 9 and continuously swings along with the climbing process of the lifting platform 2. After the slewing mechanism 4 stops working, the lifting platform 2 is in a falling trend under an action of gravity, and the pawl 84 can't be excessively flipped upwards under a limiting action of the abutting portion of the swinging rod 83, so that the pawl 84 is clamped at the abutting portion. At this time, the lifting platform 2 can't slide downwards under a locking action of the pawl 84, which plays an anti-slip role thereof.

When the pouring construction is completed and the concrete is solidified, it is necessary to lower the lifting platform 2. Under the action of the first telescopic portion 34 and the elastic member 5, the guiding wheel 312 abuts against the surface of the cylindrical building. The second telescopic portion 35 drives the telescopic member 32 to drive the pouring pipe 331 and the tamping device 332 to be away from the cylindrical building. An angle direction of the guiding wheel 312 can be adjusted by the adjusting mechanism 7 to drive the guiding wheel 312 to be in a downward inclined state. At this time, the hydraulic cylinder 81 is in an extending state, and the swinging rod 83 drives the pawl 84 to be away from the sawtooth portion 11. At this time, the slewing mechanism 4 can drive the rotary table 3 to drive the guiding wheel 312 to rotate, and the guiding wheel 312 rotates downwards along the surface of the cylindrical building and drives the lifting platform 2 to descend along the guiding rail frame 1.

Specially, the lifting platform 2 includes an annular barrel 21 communicated with a pump truck that is positioned on the ground, a mounting ring 22 rotatably arranged on the annular barrel 21 and connected with the rotary table 3, and the pouring pipe 331 communicated with the annular barrel 21 through the mounting ring 22.

Specially, both the first telescopic portion 34 and the second telescopic portion 35 are electric telescopic rods.

Although the features and elements of the present disclosure are described as above embodiments in particular combinations, which are not intended to limit the present disclosure in any way. Each feature or element can be used alone or in other various combinations within the principles of the present disclosure to the full extent indicated by the broad general meaning of the terms in which the appended claims are expressed. Any variation or replacement made by one of ordinary skill in the related art without departing from the spirit of the present disclosure shall fall within the protection scope of the present disclosure.

What is claimed is:

1. A cylindrical structure construction platform comprising:

a plurality of guiding rail frames arranged on the periphery of a cylindrical building in a circumferential array, an inner template and an outer template respectively installed on the cylindrical building, both the inner template and the outer template joined together to form an annular pouring cavity therebetween, a lifting platform movably installed on the plurality of guiding rail frames, a rotary table rotatably arranged on the lifting platform, and a plurality of adjusting members that are capable of radially moving along the rotary table arranged on the rotary table;

a roller member rotatably installed on each of the plurality of adjusting members, and a guiding wheel rotatably arranged on the roller member;

a telescopic member movably installed on each of the plurality of adjusting members, a mounting rack that is capable of vertically moving relative to the telescopic member arranged on the telescopic member, and a pouring pipe and a tamping device arranged on the mounting rack;

a slewing mechanism connected to the rotary table in a transmission connection way and driving the rotary table to rotate relative to the lifting platform;

an elastic member arranged on each of the plurality of adjusting members and pushing each of the plurality of adjusting members to drive the guiding wheel to be tightly abutted against the outer template;

a first telescopic portion connected to the elastic member in a transmission connection way and pushing each of the plurality of adjusting members to move relative to the rotary table through the elastic member;

a second telescopic portion connected to the telescopic member in a transmission connection way and driving the telescopic member to move relative to each of the plurality of adjusting members;

a lifting member arranged on each of the plurality of adjusting members and connected to the mounting rack in a transmission connection way, and configured to adjust a height position of the mounting rack;

an adjusting mechanism arranged on each of the plurality of adjusting members and connected to the roller member in a transmission connection way, and configured to adjust an angle position of the roller member;

an anti-slip mechanism that is capable of tightly clasping each of the plurality of guiding rail frames arranged on the lifting platform;

the slewing mechanism comprising a servo motor arranged on the rotary table, a driving gear, and a ring gear arranged on the lifting platform, wherein the servo motor is connected to the driving gear in a transmission connection way and configured to drive the driving gear to rotate, and the driving gear is meshed with the ring gear;

the adjusting mechanism comprising a motor, a second worm and a second worm wheel, the second worm wheel connected with the roller member and driving the roller member to rotate, the second worm meshed with the second worm wheel, and the motor connected to the second worm in a transmission connection way and configured to drive the second worm to rotate; and wherein the anti-slip mechanism comprises a hydraulic cylinder, a connecting member, a plurality of swinging rods and a pawl, wherein the plurality of swinging rods are rotatably installed on the connecting member and rotatably arranged on the lifting platform, a sliding bar arranged on the connecting member, sliding grooves arranged on the plurality of swinging rods so that the sliding bar is movably installed on the plurality of swinging rods, the hydraulic cylinder arranged on the lifting platform, a piston rod of the hydraulic cylinder connected with the connecting member and pushing the connecting member to move so as to drive the plurality of swinging rods to swing, the pawl rotatably arranged on the plurality of swinging rods, a torsion spring arranged at a joint that the plurality of swinging rods are connected with the pawl, each of the plurality of guiding rail frames comprising a sawtooth portion abutting against the pawl, the torsion spring acting on the pawl to drive the pawl to be abutted against the sawtooth portion, the plurality of swinging rods driving the pawl to be engaged or disengaged from the sawtooth portion, and an abutting portion arranged on the plurality of swinging rods and configured to abut against the pawl.

2. The cylindrical structure construction platform as claimed in claim 1, wherein the elastic member comprises a sliding base, a spring and a limiting rod arranged on each of the plurality of adjusting members, the sliding base movably installed on the limiting rod; the limiting rod comprising a limiting portion abutting against the sliding base, the spring installed on the limiting rod and pushing the sliding base to drive the sliding base to abut against the limiting portion, the first telescopic portion connected to the sliding base in a transmission connection way and pushing the sliding base to drive each of the plurality of adjusting members to move.

3. The cylindrical structure construction platform as claimed in claim 1, wherein the lifting member comprises a rack, a lifting gear and a driving member, wherein the rack is arranged on the mounting rack, the lifting gear rotatably installed on the telescopic member and meshed with the rack, and the driving member is connected to the lifting gear in a transmission connection way and drives the lifting gear to rotate.

4. The cylindrical structure construction platform as claimed in claim 3, wherein the driving member comprises a driving motor, a first worm and a first worm wheel, wherein the first worm wheel is coaxially arranged with the lifting gear and drives the lifting gear to rotate, the first worm meshed with the first worm wheel, and the driving motor connected to the first worm in a transmission connection way and driving the first worm to rotate.

5. The cylindrical structure construction platform as claimed in claim 1, wherein the lifting platform comprises an annular barrel communicated with a pump truck that is positioned on the ground, a mounting ring rotatably arranged on the annular barrel and connected with the rotary table, and the pouring pipe communicated with the annular barrel through the mounting ring.

6. The cylindrical structure construction platform as claimed in claim 1, wherein both the first telescopic portion and the second telescopic portion are electric telescopic rods.

* * * * *